US008985760B2

(12) United States Patent
Naramatsu et al.

(10) Patent No.: US 8,985,760 B2
(45) Date of Patent: Mar. 24, 2015

(54) MEDIUM TRANSPORT APPARATUS AND RECORDING APPARATUS

(71) Applicant: Seiko Epson Corporation, Tokyo (JP)

(72) Inventors: Yasuo Naramatsu, Matsumoto (JP); Tsuneyuki Sasaki, Matsumoto (JP); Eiji Kumai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/850,158

(22) Filed: Mar. 25, 2013

(65) Prior Publication Data

US 2013/0277482 A1 Oct. 24, 2013

(30) Foreign Application Priority Data

Apr. 24, 2012 (JP) ..... 2012-098825
Mar. 4, 2013 (JP) ..... 2013-041583

(51) Int. Cl.
*B41J 2/01* (2006.01)
*B65H 23/06* (2006.01)
(Continued)

(52) U.S. Cl.
CPC ..... *B65H 23/063* (2013.01); *B65H 23/02* (2013.01); *B65H 23/195* (2013.01); *B65H 18/103* (2013.01); *B65H 2511/242* (2013.01); *B65H 2301/331* (2013.01); *B65H 2404/143* (2013.01);
(Continued)

(58) Field of Classification Search
CPC ..... B41J 13/02; B41J 11/00; B41J 11/02; B41J 11/04; B41J 11/057; B41J 11/0005; B41J 11/001; B41J 11/0015; B41J 11/0085; B41J 15/00; B41J 15/04; B41J 15/06
USPC ..... 347/101, 104
See application file for complete search history.

(56) References Cited

U.S. PATENT DOCUMENTS

2009/0169777 A1* 7/2009 Missell et al. ..... 428/32.22
2010/0164164 A1 7/2010 Kondo et al.
(Continued)

FOREIGN PATENT DOCUMENTS

EP 2366552 9/2011
(Continued)

OTHER PUBLICATIONS

European Search Report for European Patent Application No. 13160363.1 dated Apr. 8, 2014.

*Primary Examiner* — Geoffrey Mruk
*Assistant Examiner* — Scott A Richmond
(74) *Attorney, Agent, or Firm* — Workman Nydegger

(57) ABSTRACT

A recording medium after printing which is discharged from a main body of a printer is guided from the main body to a support surface of a discharge support portion extending to a lower anterior side, and is wound as a roll body by a winding unit in a path that passes a tension roller. A tape-shaped elastic member is fixed on an end portion of a downstream side in a transport direction of the discharge support portion so as to extend in a width direction. An elastic friction surface is formed on the end portion of the downstream side in the transport direction of the support surface. A friction coefficient between the elastic friction surface and the recording medium is higher than the friction coefficient between a portion at an upstream side in the transport direction from the elastic friction surface in the support surface and the recording medium.

12 Claims, 5 Drawing Sheets

(51) Int. Cl.
*B65H 23/02* (2006.01)
*B65H 23/195* (2006.01)
*B65H 18/10* (2006.01)

(52) U.S. Cl.
CPC ..... *B65H 2404/5311* (2013.01); *B65H 2801/36* (2013.01); *B65H 2511/214* (2013.01); *B65H 2513/11* (2013.01); *B65H 2515/31* (2013.01)
USPC ..... 347/104; 347/101

(56) References Cited

U.S. PATENT DOCUMENTS

| | | | | |
|---|---|---|---|---|
| 2010/0316424 | A1* | 12/2010 | Sugimoto | 399/350 |
| 2011/0025796 | A1 | 2/2011 | Matsuya | |
| 2012/0044309 | A1 | 2/2012 | Wanibuchi et al. | |
| 2012/0062641 | A1* | 3/2012 | DeJong et al. | 347/19 |

FOREIGN PATENT DOCUMENTS

| | | |
|---|---|---|
| JP | 51-034804 | 3/1976 |
| JP | 59-138552 | 8/1984 |
| JP | 60-117356 | 8/1985 |
| JP | 61-211075 | 9/1986 |
| JP | 01-076841 | 5/1989 |
| JP | 04-122094 | 4/1992 |
| JP | 04-214374 | 8/1992 |
| JP | 04-270672 | 9/1992 |
| JP | 04-122094 | 10/1992 |
| JP | 05-085095 | 4/1993 |
| JP | 06-106895 | 4/1994 |
| JP | 07-018849 | 1/1995 |
| JP | 08-174928 | 7/1996 |
| JP | 10-119401 | 5/1998 |
| JP | 11-049387 | 2/1999 |
| JP | 2004-107021 | 4/2004 |
| JP | 2007-245599 | 9/2007 |
| JP | 2009-184151 | 8/2009 |
| JP | 2010-280472 | 12/2010 |
| JP | 2012-040735 | 3/2012 |

* cited by examiner

MEDIUM TRANSPORT APPARATUS AND RECORDING APPARATUS

BACKGROUND

1. Technical Field

The present invention relates to a medium transport apparatus provided with a transport unit which transports a long medium, and a winding unit which winds the medium transported by the transport unit, and to a recording apparatus.

2. Related Art

For example, JP-A-2004-107021 (for example, FIG. 1 or the like) discloses a medium transport apparatus provided with a transport unit (a grip unit) which transports a long recording medium dispatched from a roll-shaped medium (for example, roll paper) loaded in a feed unit to a downstream side while pinching the recording medium between a drive roller and a driven roller (a pinch roller), and a winding unit (a winding scroller) which winds the recording medium transported by the transport unit to the downstream side into a roll shape. A recording apparatus provided with this medium transport apparatus is provided with a recording unit that performs recording (printing) on a portion of the recording medium which is on a medium support portion (a platen) arranged further on the downstream side than the transport unit. After the recording, the recording medium discharged along the paper guide is wound onto the winding unit while tension is applied to the recording medium by a tension roller applying pressure to a portion between the paper guide and the winding unit.

Here, there is a case in which the recording medium is wound onto the winding unit at a position deviated in the width direction in relation to the position at which the recording medium is pinched in the transport unit. In this case, when the biased force during the winding, caused by the winding position in the winding unit deviating in the width direction, propagates to the upstream side, the recording medium in the transport unit deviates in the width direction through the propagated force. This causes the recording medium to skew or meander between the transport unit and the winding unit.

For example, JP-A-2007-245599 (for example, FIG. 5 or the like), JP-A-8-174928 (for example, paragraph 10 or the like) and JP-A-4-270672 (for example, paragraph 10, FIG. 2 or the like) disclose technology in which the friction coefficient of all or part of the peripheral surface of the roller that configures the transport unit (a transport roller or a platen roller) is increased. For example, in JP-A-2007-245599 (for example, FIG. 5 or the like), a friction application member is formed on the transport roller. In addition, in JP-A-8-174928, the surface of a rubber elastic body covering the core material of the platen roller is coated with a fluorine resin, thereby the surface is formed with a friction coefficient value of, for example, 0.4 to 0.6 in relation to the recording medium. In addition, JP-A-4-270672 (for example, paragraph 10, FIG. 2 or the like) provides a belt skew correction unit which includes a correction roller, in which rubber rollers having a relatively large friction coefficient are mounted to both end portions, and functions as a guide roller which applies tension.

However, in the medium transport apparatus of a configuration in which the medium is wound by the winding unit, as in JP-A-2004-107021 (for example, FIG. 1 or the like), in a case in which the medium is wound with a bias, as described above, even if deviation in the width direction of the recording medium is to be suppressed by frictional resistance at a position of the transport unit which is distanced from the winding unit on the upstream side, the portion of the downstream side of the recording medium deviates greatly. Therefore, a very large frictional resistance force is necessary in order to suppress the deviation at the position of the transport unit of the upstream side. Meanwhile, in a case in which the friction coefficient of the roller is significantly increased, there is a concern that the recording medium will jam during transport due to the extremely large frictional resistance force that the recording medium receives from the roller. In a case in which this type of jamming occurs, problems occur, such as the recording medium becoming inclined or the transport position accuracy dropping due to not being able to transport by the necessary transport amount.

Accordingly, as in JP-A-2007-245599 (for example, FIG. 5 or the like), JP-A-8-174928 (for example, paragraph 10 or the like) and JP-A-4-270672 (for example, paragraph 10, FIG. 2 or the like), even if the friction coefficient of all or part of the roller is increased, there is a problem in that it is difficult to sufficiently suppress the skewing or the meandering of the medium between the transport unit and the winding unit, where the skewing or the meandering of the medium is caused by the winding position of the medium in the winding unit being biased in a direction (the width direction) which is perpendicular to the transport direction.

SUMMARY

An advantage of some aspects of the invention is to provide a medium transport apparatus and a recording apparatus in which, even if the winding position of the medium in the winding unit is biased in a direction which is perpendicular to the transport direction, it is possible to suppress the skewing or the meandering of the medium between the transport unit and the winding unit, where the skewing or the meandering of the medium is caused by the propagation of the biased force during the winding to the upstream side.

According to an aspect of the invention, there is provided a medium transport apparatus that includes a transport unit which transports a long medium to a downstream side; a winding unit which winds the medium transported to the downstream side by the transport unit; and a medium support portion which is arranged between the transport unit and the winding unit in a transport path and has a medium support surface which supports the medium, in which a friction coefficient between the medium support surface at an end portion of the downstream side in the transport direction and the medium is higher than a friction coefficient between the medium support surface at an upstream side in the transport direction from the end portion of the downstream side and the recording medium.

In this case, the friction coefficient between the medium support surface at the end portion of the downstream side in the transport direction and the medium is higher than the friction coefficient between the medium support surface at the upstream side in the transport direction from the end portions of the downstream side of the medium support surface. Therefore, even if the winding position of the medium in the winding unit is biased, the propagation of the biased force to the upstream side in the transport direction of the medium during the winding is more easily prevented by the end portions of the downstream side of the medium support surface. Accordingly, it is possible to effectively suppress the deviation in a direction (the width direction) which is perpendicular to the transport direction of the medium between the transport unit and the winding unit (for example, the vicinity of the transport unit) caused by the propagation of the biased force to the upstream side in the transport direction of the medium during the winding.

According to the aspect, it is preferable that the difference between the static friction coefficient and the kinetic friction coefficient, between the medium support surface at the end portion of the downstream side and the medium, be 0.1 or less.

In this case, the difference between the static friction coefficient and the kinetic friction coefficient, between the medium support surface at the end portion of the downstream side and the medium, is 0.1 or less, which is small. Therefore, it is possible to move the medium comparatively smoothly from a stationary state. For example, when the difference between the static friction coefficient and the kinetic friction coefficient is great, there is a concern that jamming will occur when the medium is moved from a stationary state, and this jamming, for example, is a cause of deviation of the transport amount in both ends of the medium in the width direction. However, since the difference between the static friction coefficient and the kinetic friction coefficient is 0.1 or less, which is small, jamming does not occur, and, for example, it is possible to suppress the deviation of the transport amount in both ends of the medium in the width direction. This configuration is particularly valid in a case of a configuration of an intermittent transport system in which the stopping and the movement of the medium is frequently repeated.

According to the aspect, it is preferable to provide an elastic member formed from an elastomer on the end portion of the downstream side of the medium support surface.

In this case, while the necessary sliding resistance is applied to the medium by the elastic member formed from an elastomer and provided on the end portion of the downstream side of the medium support surface, it is possible to render the sliding face of the medium less susceptible to scratching through the elasticity of the elastomer.

According to the aspect, it is preferable that the elastic member form a first support surface portion of a substantially flat planar surface shape on which a medium which is discharged without being wound by the winding unit and a medium which is wound by the winding unit can slide together; and a second support surface portion of a convex surface shape which is continuous with the first support surface portion on the downstream side in the transport direction and curves to a side distanced from the medium when the medium is positioned on the first support surface portion, and on which the medium wound by the winding unit can slide.

In this case, since the medium not to be wound slides on the first support surface portion and does not slide on the second support surface portion within the elastic member, the sliding surface area with the elastic member is comparatively small and the medium is transported without significantly jamming at the end portion of the downstream side of the medium support surface. Meanwhile, the medium that the winding unit winds slides on both the first support surface portion and the second support surface portion among the elastic members, and receives a comparatively great sliding resistance from the elastic member due to the wide sliding surface area. As a result, even in a case in which the medium is wound with a bias by the winding unit, it is possible to make the biased force during the winding less apt to propagate to the upstream side in the transport direction.

According to the aspect, it is preferable that the medium transport apparatus further include a pressing portion which applies tension to the medium by pressing a portion thereof between the medium support portion and the winding unit, and be provided to swing freely; in which the second support surface portion is preferably provided across the range over which a sliding position of the medium in relation to the medium support surface is changed according to the change in the transport path between the medium support portion and the pressing portion.

In this case, the second support surface portion is provided across the range over which the sliding position of the medium in relation to the medium support surface is changed according to the change in the transport path of the medium which passes through the pressing portion between the medium support portion and the pressing portion. Accordingly, it is possible to apply a comparatively large sliding resistance at the sliding location between the medium and the medium support surface, where the medium is to be wound by the winding unit while tension is applied thereto through contact with the pressing portion, while suppressing the jamming at the end portion of the downstream side of the medium support surface of the medium not to be wound by the winding unit as much as possible. Even in a case in which the medium were to be wound with a bias, the biased force during the winding may be made less apt to propagate to the upstream side in the transport direction.

According to the aspect, it is preferable that the first support surface portion be shorter than the second support surface portion in relation to a direction along the transport path.

In this case, since the sliding surface area in which the medium discharged without being wound slides on the first support surface portion is comparatively small, the medium is less apt to catch on the end portion of the downstream side of the medium support surface. Meanwhile, since the medium to be wound slides on at least a portion of the first support surface portion and the second support surface portion, the medium receives a comparatively large sliding resistance due to the relatively wide sliding surface area, and the biased force during the winding is less apt to propagate to the upstream side in the transport direction from the end portion of the downstream side of the medium support surface.

According to another aspect of the invention, there is provided a recording apparatus including the medium transport apparatus according to the above inventions; and a recording unit which performs recording on a recording medium transported by the medium transport apparatus.

In this case, since the recording apparatus is provided with the medium transport apparatus according to the invention and a recording unit which performs recording to a medium transported by the medium transport apparatus, the actions and effects according the medium transport apparatus of the invention may be obtained in a similar manner thereto.

BRIEF DESCRIPTION OF THE DRAWINGS

The invention will be described with reference to the accompanying drawings, wherein like numbers reference like elements.

DESCRIPTION OF EXEMPLARY EMBODIMENTS

A specific embodiment of the invention will be described below on the basis of FIGS. 1 to 6C.

Figure 1:
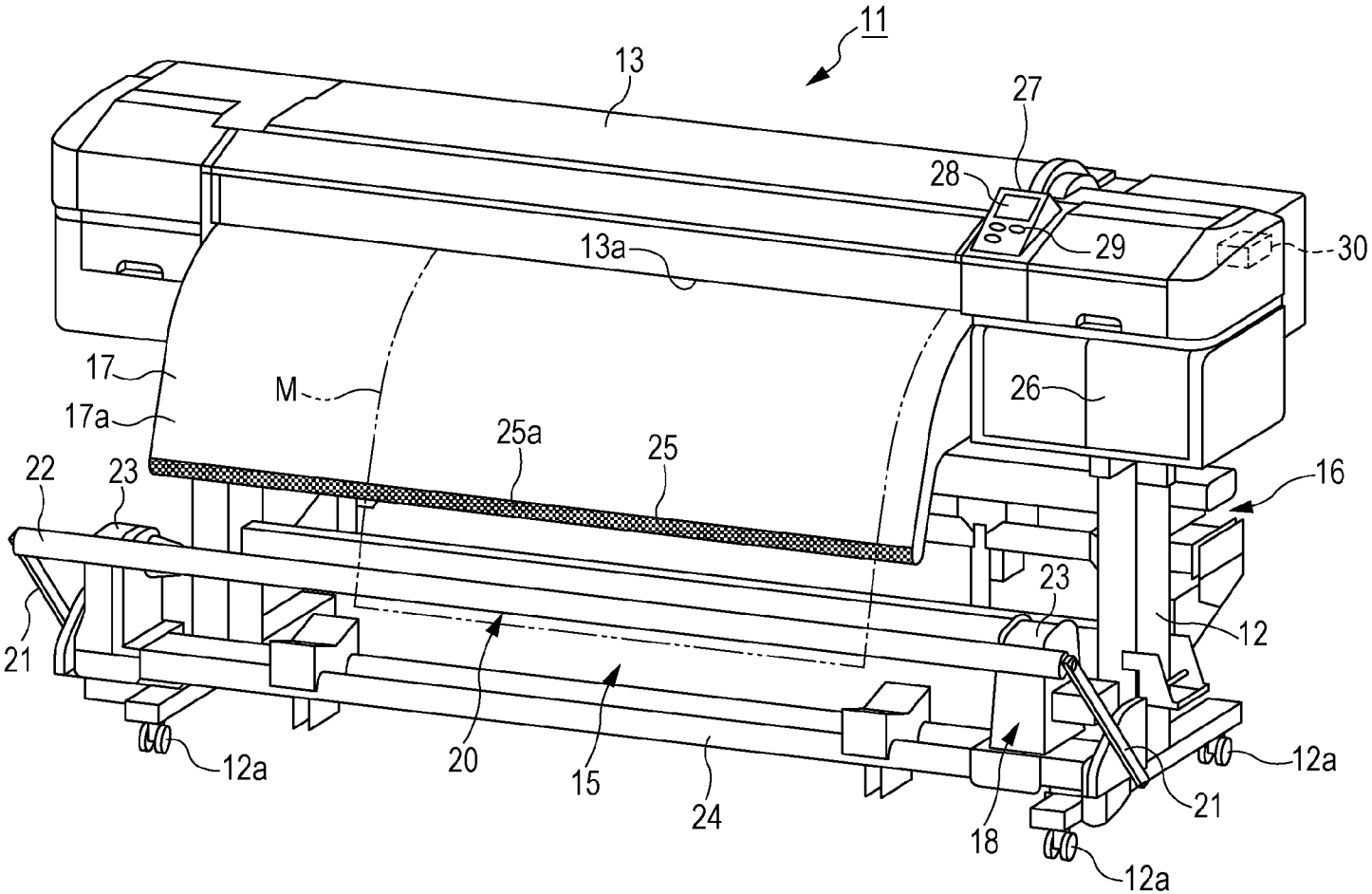
FIG. 1 is a perspective view of a printer in an embodiment.

As an example of the recording apparatus shown in FIG. 1, a printer 11 is a large format printer (an LFP) which handles a recording medium M as an example of the medium of a comparatively large size such as A0 or B0 of the JIS standard. The recording medium M is formed from a long sheet of a predetermined width, and for example, is formed from a resin film, paper or the like.

As shown in FIG. 1, the printer 11 is provided with a foot base 12 (a stand) having a plurality of casters 12*a* on the lower edge, and a main body 13 of a substantially rectangular shape supported on the foot base 12. In addition, the printer 11 is provided with a medium transport apparatus 15 which transports the recording medium M which is a roll-to-roll system and is long.

Figure 2:
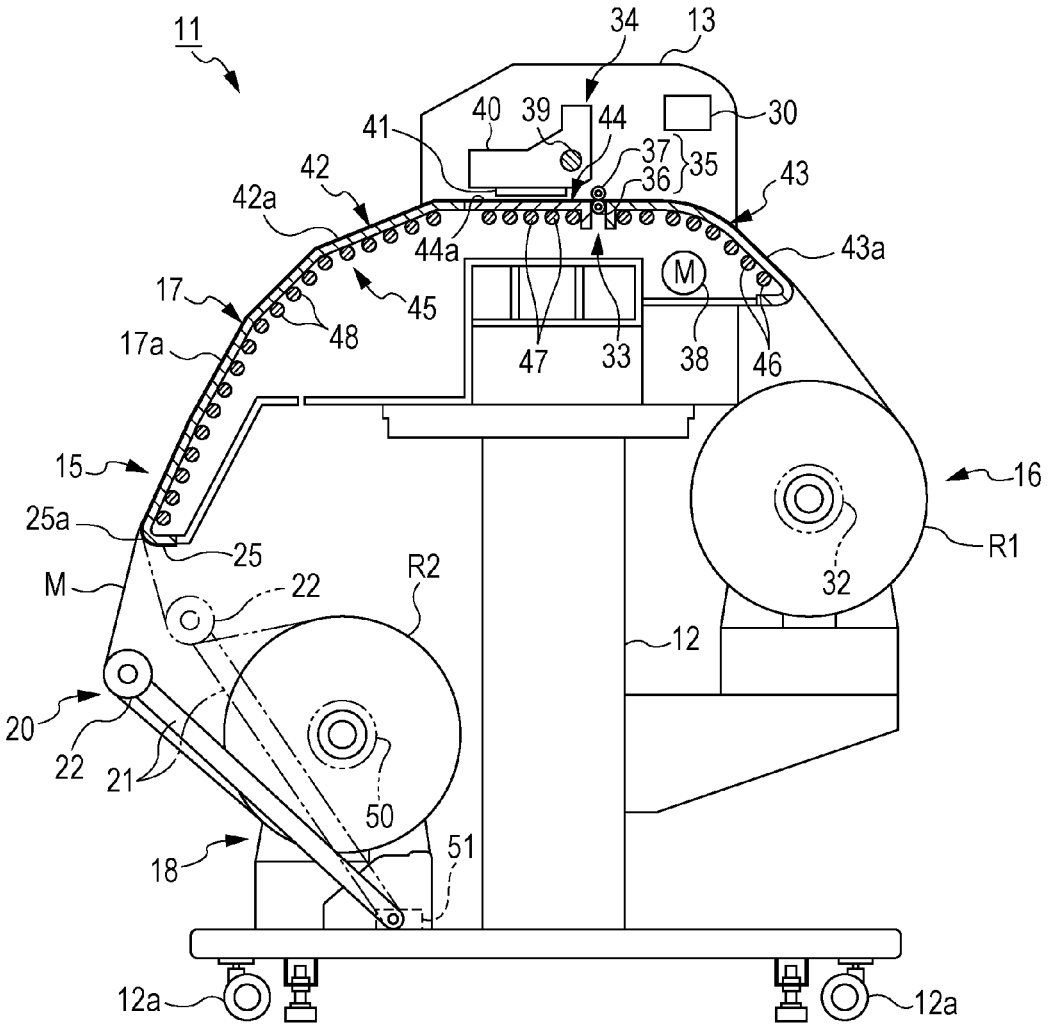
FIG. 2 is a side cross-sectional view of the printer.

The medium transport apparatus 15 is provided with a feed unit 16 provided on the lower rear side of the main body 13, a discharge support portion 17 which, using a support surface 17*a*, supports the recording medium M which is discharged from a discharge port 13*a* of the main body 13 after being fed from the feed unit 16 to within the main body 13 and printing being performed on the printing medium M, and a winding unit 18 which winds the recording medium M after printing further to the downstream side on the transport path onto a roll body R2 (refer to FIG. 2). The discharge support portion 17 of the present example extends from the lower side of the discharge port 13*a* of the main body 13 in an obliquely downward manner, and is formed as a curved surface on which the support surface 17*a* swells slightly forwards. The recording medium M after printing is guided in an obliquely downward manner along the support surface 17*a*. Furthermore, the winding unit 18 is arranged below the discharge support portion 17 in a state of being supported by the foot base 12. Furthermore, in the present embodiment, an example of the medium support portion is configured by the discharge support portion 17, and an example of the medium support surface is configured by the support surface 17*a*.

A tension application mechanism 20, which applies tension (tensile force) to a portion between the discharge support portion 17 of the recording medium M and the winding unit 18, is provided at a position in the vicinity of the winding unit 18. The tension application mechanism 20 is provided with a pair of arm members 21 supported movably on the lower portion of the foot base 12, and a tension roller 22 as an example of the pressing portion supported movably on the distal end portion of the pair of arm members 21. The tension roller 22 has a longer shaft length than the anticipated maximum width of the recording medium M, makes contact with the reverse face of the recording medium M and the entire range of the width direction (the direction orthogonal to the paper surface of FIG. 1) thereof, and by pressing this range, the winding unit 18 is able to wind the recording medium M in a state of tension being applied.

The winding unit 18 is provided with a pair of holders 23 which pinch a core (for example, a paper tube, not shown), onto which the recording medium M after printing is wound in a roll shape, from both axial directions. It is possible to adjust the interval of the pair of holders 23 in accordance with the width of the recording medium M by moving one of the pair in the width direction along a rail 24. The recording medium M is wound in a roll shape onto the core which is mounted between the pair of holders 23 due to one of the holders 23 (the holder on the right side in FIG. 1) being rotationally driven. Furthermore, the winding unit 18 of the present embodiment is a spindle-less type which does not use a spindle. However, a type which uses a spindle may also be used.

As shown in FIG. 1, on the support surface 17*a* of the discharge support portion 17, the elastic member 25 is provided on the end portion of the downstream side in the transport direction. An example of the elastic member 25 has a fixed width in the transport direction and is provided across the entire range of the width direction of the support surface 17*a*. The elastic member 25 is formed from, for example, a tape having elasticity with a comparatively high friction coefficient to the recording medium M. By providing the elastic member 25, an elastic friction surface 25*a* formed from the surface of the elastic member 25 is formed on the end portion of the downstream side in the transport direction of the support surface 17*a*.

In addition, an ink cartridge accommodation portion 26 to which ink cartridges (not shown) can be loaded and an operation panel 27 are provided on the right side portion of the main body 13 in FIG. 1. The operation panel 27 is provided with a display unit 28 on which the printing conditions setting screen is displayed and an operation unit 29 which is operated when the input and various types of command of the printing conditions or the like are applied. Furthermore, a control unit 30 which controls all of the operation of the printer 11 is provided within the main body 13.

Next, the detailed configuration of the printer 11 will be described on the basis of FIG. 2. As shown in FIG. 2, the feed unit 16 is provided with a motor 32 for feeding which outputs a rotational drive force to one of the holders of a pair of holders (not shown) which interpose a roll body R1 in the axial direction thereof. The recording medium M is dispatched into the main body 13 due to the motor 32 for feeding being driven and the roll body R1 rotating in the dispatch direction.

A transport unit 33 which transports the recording medium M and a recording unit 34 which is provided in a position at the downstream side in the transport direction from the transport unit 33 and records (prints) onto the recording medium M are provided within the main body 13. The transport unit 33 is provided with a transport roller pair 35 which transports the recording medium M while pinching (nipping) the recording medium M. The transport roller pair 35 is provided with a transport drive roller 36 which is arranged on the lower side of the transport path and performs rotational driving, and a transport driven roller 37 of the upstream side which rotates following the rotation of the transport drive roller 36. A motor 38 for transporting, which is the power source that outputs a rotational drive force to the transport drive roller 36, is provided within the main body 13. The recording medium M pinched between both of the rollers 36 and 37 is transported to the downstream side in the transport direction due to the rotational driving of the transport drive roller 36 driven by the motor 38 for transporting.

As shown in FIG. 2, the recording unit 34 is provided with a carriage 40 which reciprocally moves in the main scanning direction orthogonal to the transport direction of the recording medium M (the direction orthogonal to the paper surface in FIG. 2) along a guide shaft 39 installed within the main body 13. The carriage 40 is fixed to an endless timing belt (not shown) to which the force of the carriage motor (not shown) is transmitted. The reciprocal movement of the carriage 40 in the main scanning direction is made possible by the forward and reverse driving of the carriage motor. The carriage 40 includes a recording head 41 opposite to the transport path. In the process of the carriage 40 moving in the main scanning direction, printing to the recording medium M is performed by the recording head 41 ejecting the ink, which is supplied from an ink cartridge (not shown), from the nozzles. At this time, for the printing operation, a recording operation in which ink droplets are ejected from the recording head 41 while the carriage 40 moves in the main scanning direction and a transport operation in which the recording medium M is transported in the transport direction to the next recording position are performed substantially alternately. Accordingly, the printing of the image to the recording medium M is performed on the basis of the printing data. In this manner, in the printer 11, during the printing, one intermittent transportation of the recording medium M by the transport distance of one pass to the execution position of the next pass is performed for each pass in which the carriage 40 moves once in the main scanning direction.

A support member 42, which includes a support surface 42*a* that bends and supports the recording medium M such that the recording medium M becomes convex upward, is provided between the feed unit 16 and the winding unit 18. The support member 42 is configured by assembling a plurality of members of a predetermined shape which are formed by bending plates formed from sheet metal or the like.

The support member 42 is provided with a support portion 43 for feeding that supports the recording medium M fed from the roll body R1 using the support surface 43*a*, a support portion 44 for recording that, using the support surface 44*a*, supports a portion of the recording medium M which is the printing region according to the recording head 41, and the discharge support portion 17 described later which includes the support surface 17*a* that guides the recording medium M after printing from the main body 13 to the lower anterior side (the lower left side in FIG. 2). Each of the support portions 43, 44 and 17 are arranged in a state in which the respective support surfaces 43*a*, 44*a* and 17*a* thereof are connected continually in a substantially flush manner.

As shown in FIG. 2, a heating unit 45 which heats the support surface 42*a* is provided on the rear side of the support member 42. The heating unit 45 is provided with a pre-heater 46 which preheats the recording medium M during the feeding on the support surface 43*a*, a platen heater 47 which heats the recording medium M during the printing on the support surface 44*a*, and an after-heater 48 which dries the adhered ink by heating the recording medium M after the printing on the support surface 17*a*. The heating unit 45 includes a function of improving the print quality by quickly drying and fixing the ink to the recording medium M and preventing bleeding and blurring.

As shown in FIG. 2, the winding unit 18 is provided with a motor 50 for winding which outputs a rotational drive force to one of the pair of holders 23 (refer to FIG. 1) which interpose the roll body R2 in the axial direction thereof. The recording medium M is wound onto the roll body R2 due to the motor 50 for winding being driven and the roll body R2 rotating in the winding direction. Each of the motors 32, 38 and 50 are electrically connected to the control unit 30 within the main body 13. The control unit 30 of the present example performs speed control on each of the motors 32, 38 and 50 using, for example, PWM control (pulse width modulation control). Naturally, the motor control system according to the control unit 30 may be changed to an appropriate control system.

In addition, a sensor 51 which detects the tilt angle of the arm members 21 is provided on the base end portion of one of the arm members 21 that supports the tension roller 22. The control unit 30 controls the motor 50 for winding on the basis of a detection signal representing the tilt angle input from the sensor 51, such that the tilt angle of the arm members 21 stays within a fixed range. According to the control of the motor 50 for winding, the recording medium M after the printing is wound onto the roll body R2 in a state in which tension of a substantially fixed range is applied to the recording medium M.

As shown in FIG. 2, the arm members 21 change the tilt angle in accordance with a difference in the winding direction of the recording medium M onto the roll body R2. That is, in a case in which the winding direction of the recording medium M onto the roll body R2 is the "external winding" represented by solid lines in FIG. 2, the arm members 21 which support the tension roller 22 pressing the recording medium M incline forward (leftward in FIG. 2), and the recording medium M spanning from the discharge support portion 17 via the tension roller 22 to the roll body R2 adopts the transport path represented by solid lines in FIG. 2. Meanwhile, in a case in which the winding direction of the recording medium M onto the roll body R2 is the "internal winding" represented by two-dot chain lines in FIG. 2, the arm members 21 which support the tension roller 22 pressing the recording medium M adopt a tilt angle rotated slightly backward (rightward in FIG. 2), in comparison with the external winding. Accordingly, the recording medium M which spans from the discharge support portion 17 via the tension roller 22 to the roll body R2 adopts the transport path represented by the two-dot chain lines in FIG. 2. In addition, the position of the tension roller 22 also changes in accordance with a change in the winding diameter of the roll body R2. When the roll body R2 in FIG. 2 has a maximum anticipated diameter, the transport path between the discharge support portion 17 and the tension roller 22 adopts a transport path within the range between the transport path represented by solid lines in FIG. 2, which is most exterior, and the transport path represented by two-dot chain lines in FIG. 2, which is most interior.

Furthermore, in the printer 11 of the present embodiment, a specification in which the recording medium M is wound onto the roll body R2 and a specification in which the recording medium M is discharged without being wound are possible. In the latter case, the recording medium M after printing hangs down from the end portion of the downstream side of the discharge support portion 17, and is accommodated by, for example, a discharge basket (not shown).

Figure 3:
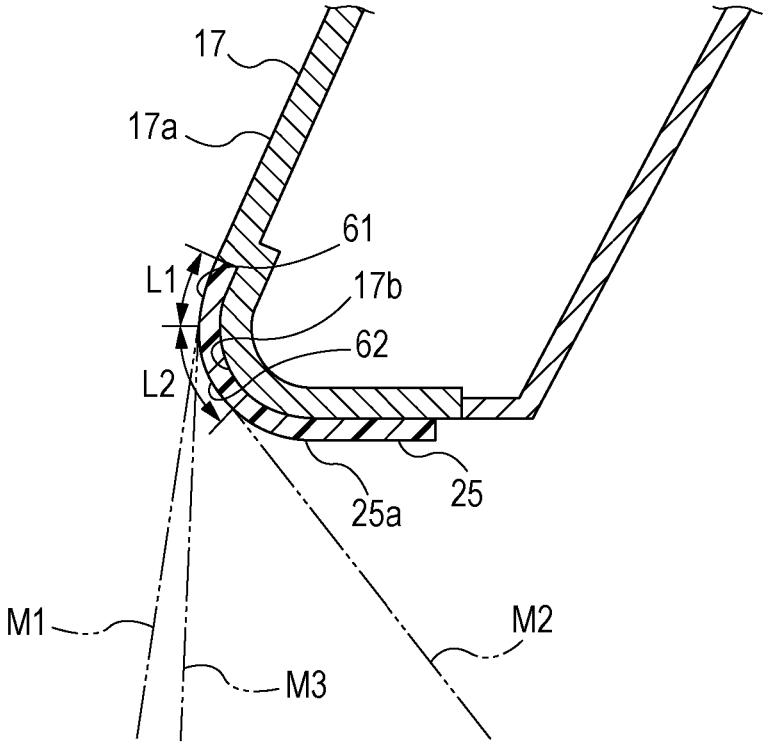
FIG. 3 is a side cross-sectional view schematically showing the end portion of the downstream side of the discharge support portion.

Next, description will be given of the elastic member 25 with reference to FIG. 3. As shown in FIG. 3, the transport path between the discharge support portion 17 and the tension roller 22 moves in a range between when a path M1, which is most exterior (to the left side in FIG. 3), is adopted during external winding, and when a path M2, which is most interior (to the right side in FIG. 3), is adopted during internal winding. Furthermore, whichever transport path the recording medium M adopts within this range, the elastic member 25 is attached across a predetermined range in a direction along the transport path, such that the recording medium M slides only on the elastic friction surface 25*a* in relation to the end portion of the downstream side of the support surface 17*a*. Furthermore, the elastic member 25 is also provided on a region of the end surface of the downstream side of the discharge support portion 17 that the recording medium M may not make contact with.

On the end portion of the downstream side in the transport direction of the discharge support portion 17, a step-shaped concave portion 17*b* of a depth approximately the same as the tape thickness of the elastic member 25 is formed across the entire range of the width direction. Further, the elastic friction surface 25*a* is formed by the elastic member 25 being bonded to the concave portion 17*b*.

The elastic friction surface 25*a* includes a first support surface portion 61 of a substantially flat planar surface shape which extends to the downstream side approximately parallel to a surface at the upstream side of the support surface 17*a* from the elastic friction surface 25*a*. The elastic friction surface 25*a* also includes a second support surface portion 62 of a convex surface shape which is continuous with the first support surface portion 61 on the downstream side and curves to a side distanced from the recording medium M when the recording medium M is positioned on the first support surface portion 61. In a case in which the recording medium M is discharged without being wound, as shown in FIG. 3, the recording medium M adopts a path M3 which hangs down in a substantially gravity direction from the end portion of the downstream side of the discharge support portion 17. The first support surface portion 61 is a sliding surface on which the recording medium M which is discharged without being wound by the winding unit 18 and the recording medium M which is wound by the winding unit 18 both slide. In addition, the second support surface portion 62 is a sliding surface on which the recording medium M which is discharged without being wound by the winding unit 18 does not slide and the recording medium M which is wound by the winding unit 18 slides. That is, the second support surface portion 62 is provided across the range over which the sliding position of the recording medium M in relation to the support surface 17*a* is changed according to the change in the transport path between the discharge support portion 17 and the tension roller 22. However, in the present example, of the recording media M to be wound, the recording medium M which adopts a path closer to the path M2 side than the path M3 side slides on the second support surface portion 62.

Furthermore, as shown in FIG. 3, a length L1 of the direction along the transport path of the first support surface portion 61 is shorter than a length L2 of the direction along the transport path of the second support surface portion 62. For example, the length L1 is a predetermined value within a range of 1 mm to 10 mm. This is to shorten the length L1, reduce the sliding surface area of the recording medium M, which was discharges without being wound, in relation to the elastic friction surface 25*a*, and to suppress the jamming of the recording medium M caused by the sliding resistance received from the elastic friction surface 25*a*. In addition, in most cases in which the recording medium M to be wound adopts a path closer to the path M2 side than the path M3 side, the sliding surface area in relation to the first support surface portion 61 is added to the sliding surface area in relation to at least a portion of the second support surface portion 62, thereby relatively increasing the sliding resistance that the recording medium M receives from the elastic friction surface 25*a*. In addition, of the recording media M to be wound, it is possible for the recording medium M which adopts a path closer to the path M1 side than the path M3 side to receive sliding resistance by sliding on a large portion of the first support surface portion 61. Furthermore, in the present embodiment, an example of the medium support portion is configured by the discharge support portion 17, and an example of the medium support surface is configured by the support surface 17*a*.

The elastic member 25 is formed from, for example, an elastomer. In the present embodiment, an EPT-based thermoplastic elastomer (TPE) is used as an example of the elastomer. Specifically, the thermoplastic elastomer with a product name of "TPE sheet", a model number of "TB965N" (manufactured by KUREHA ELASTOMER Co., Ltd.), which is black, and 0.5 mm thick was used.

Figure 4:
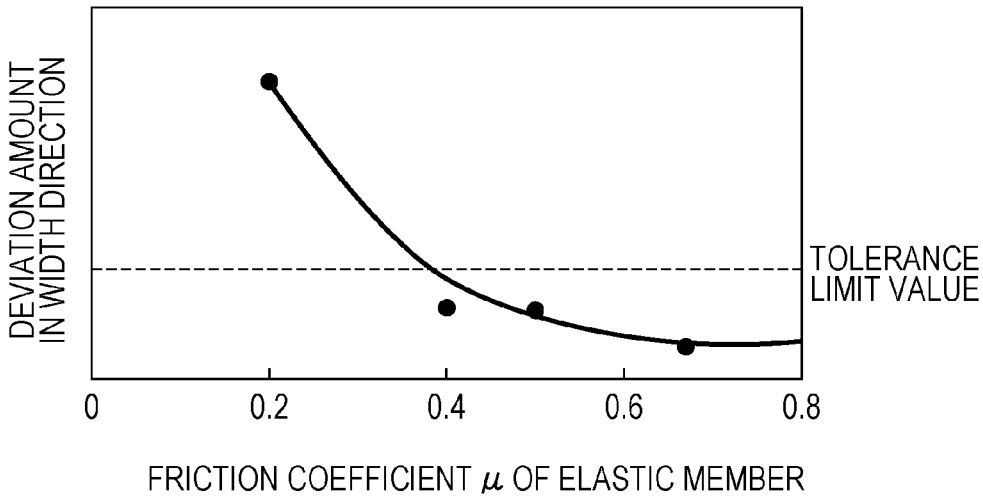
FIG. 4 is a graph showing the relationship between the friction coefficient and the deviation amount in the width direction of the recording medium.

A test to evaluate the elastic member 25 of the material described above was performed. The evaluation results thereof will be described below. FIG. 4 shows the relationship between the friction coefficient μ of the elastic member 25 and the deviation amount in the width direction of the recording medium M during transport. Four types of elastic member having different friction coefficients μ were prepared and respectively bonded to the concave portion 17*b* formed on the end portion of the downstream side of the discharge support portion 17. For the elastic member, four types of material having friction coefficients μ of 0.2, 0.4, 0.5 and 0.68 were used. A test pattern of a predetermined resolution was printed onto the recording medium M using the recording head 41 while performing winding of the recording medium M at the downstream side in the transport direction using the winding unit 18. This printing of a test pattern was performed in relation to four types of the elastic member 25 having friction coefficients μ of 0.2, 0.4, 0.5 and 0.68. Using the printed test pattern, from the position of the printed dots on the recording medium M, the positional deviation amount in the width direction of the recording medium M for a predetermined distance was measured. This measurement was performed a plurality of times in relation to each of the elastic members 25, and the average value of the obtained measured values was acquired.

FIG. 4 is a graph showing the measurement results, where the horizontal axis is the friction coefficient μ of the elastic member and the vertical axis is the deviation amount in the width direction of the recording medium M. As can be understood from the graph shown in FIG. 4, when the friction coefficient μ is 0.4 or higher (μ≥0.4), the deviation amount in the width direction of the recording medium M for a predetermined distance stays within a tolerance limit value or less. The tolerance limit value is a value determined from a tolerance limit value of the deviation in the width direction of the printed dots, which is determined from the demanded print quality. Accordingly, in the present embodiment, an elastic member 25 which satisfies "friction coefficient μ≥0.4" is used, and the friction coefficient μ1 of the elastic friction surface 25*a* is set to 0.4 or higher (for example, values in the range of 0.4 to 0.7). In the support surface 17*a*, a portion at the upstream side in the transport direction from the elastic friction surface 25*a* is formed using a metal surface in the present example, and the friction coefficient 42 between the metal surface and the recording medium M is, for example, a value within the range of 0.1 to 0.2. Therefore, the friction coefficient μ1 between the elastic friction surface 25*a* formed on the end portion of the downstream side of the support surface 17*a* and the recording medium M is higher than the friction coefficient μ2 between a portion at the upstream side in the transport direction from the elastic friction surface 25*a* in the support surface 17*a* and the recording medium M.

Figure 5:
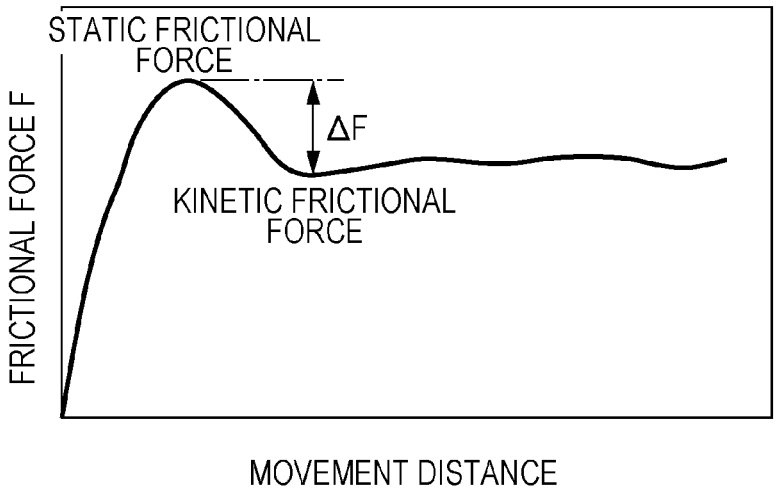
FIG. 5 is a graph illustrating the difference between the static frictional force and the kinetic frictional force.

FIG. 5 shows the relationship between the movement distance that the recording medium M has been moved on the elastic friction surface 25*a* from a stationary state and the frictional force F that the recording medium M receives from the elastic friction surface 25*a*. As can be understood from the graph, a great static frictional force acts on the recording medium M during the start of the movement, and during the movement of the recording medium M a smaller kinetic frictional force acts on the recording medium M than the static frictional force. At this time, when the difference between the static frictional force and the kinetic frictional force is great, jamming occurs during the start of the movement of the recording medium M, which has a detrimental effect on the transport position accuracy of the recording medium M. That is, at both end portions (the left and right ends) in the width direction of the recording medium M, the transport amount differs slightly due to jamming and the recording medium M is transported at a slightly oblique angle. In addition, even in a case in which the recording medium M is transported straight in the transport direction, when the transport amount is less than a target value due to jamming, the transport position accuracy of the recording medium M is reduced. This type of jamming is determined from the difference ΔF between the static frictional force and the kinetic frictional force, which depends on the difference Δμ between the static friction coefficient and the kinetic friction coefficient (hereinafter, also referred to as the "static-kinetic friction coefficient difference Δμ"). Therefore, in order to discover the favorable conditions of the static-kinetic friction coefficient difference Δμ in which this type of jamming can be suppressed to a tolerance limit value or less, a test was performed to evaluate the relationship between the transport distance of the recording medium M and fluctuation amount in relation to the target value of the transport distance.

The elastic members 25 were prepared for a plurality of materials having different differences Δμ between the static friction coefficient and the kinetic friction coefficient. Furthermore, each of the elastic members 25 was bonded to the concave portion 17*b* formed on the end portion of the downstream side of the discharge support portion 17, and the elastic friction surface 25*a* was formed. There are three types of the static-kinetic friction coefficient difference Δμ of the elastic members 25 to evaluate, Δμ=0, 0.1 and 0.2.

Then, a test pattern of a predetermined resolution was printed onto the recording medium M using the recording head 41 while performing winding of the recording medium M at the downstream side in the transport direction using the winding unit 18. This printing of a test pattern was performed in relation to three types of the elastic member 25 having static-kinetic friction coefficient differences Δμ of 0, 0.1 and 0.2. Using the printed test pattern, in relation to three locations in the width direction of the recording medium M, the fluctuation of the actual transport distance in relation to the transport distance Xpf=X pass (target value) for one pass was measured from the position of the printed dots on the recording medium M. The three locations to be measured were set to the center position in the width direction of the recording medium M, the end portion of the home position side (the right end of the recording medium M in FIG. 1) at which the carriage 40 stands-by when not printing, and the end portion of the side opposite the home position (the left end of the recording medium M in FIG. 1). This measurement was performed a plurality of times in relation to each of the elastic members 25, and the average value of the obtained measured values was acquired.

Figure 6A:
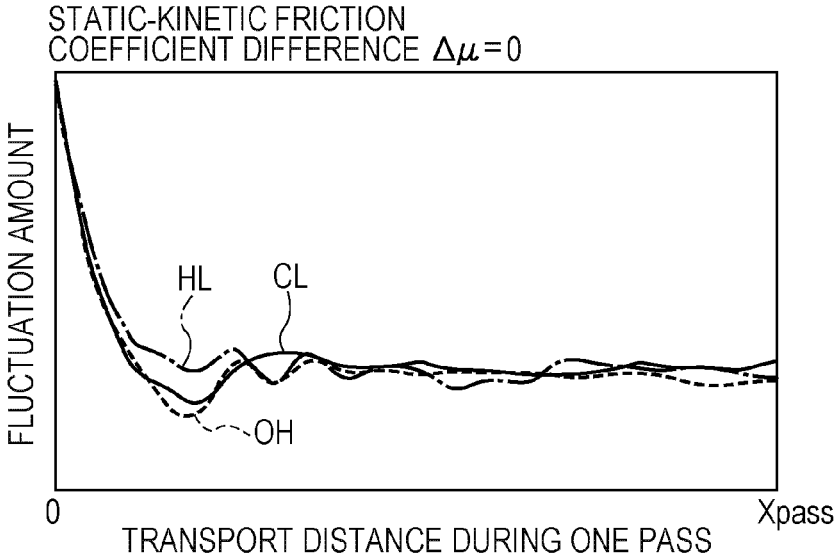
FIGS. 6A to 6C are graphs showing the relationship between the static-kinetic friction coefficient difference $\Delta\mu$ and the fluctuation amount of the actual transport distance.
Figure 6B:
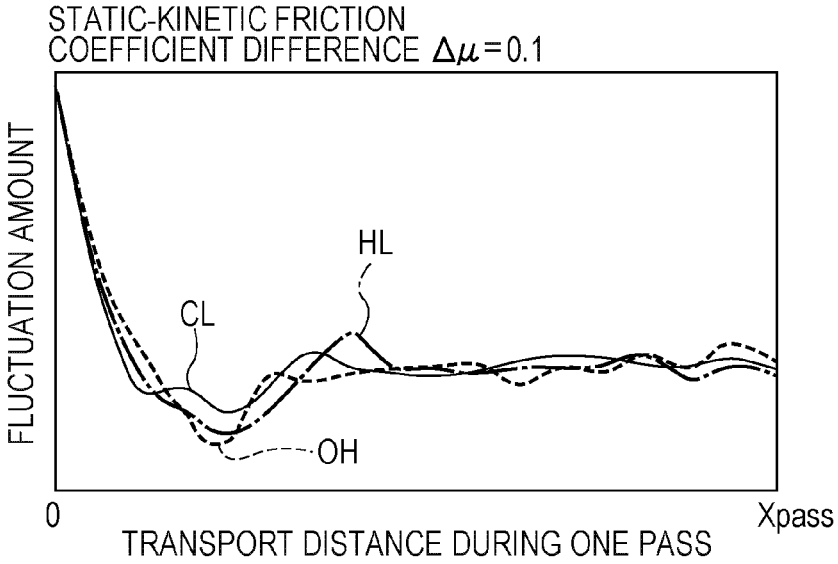
Figure 6C:
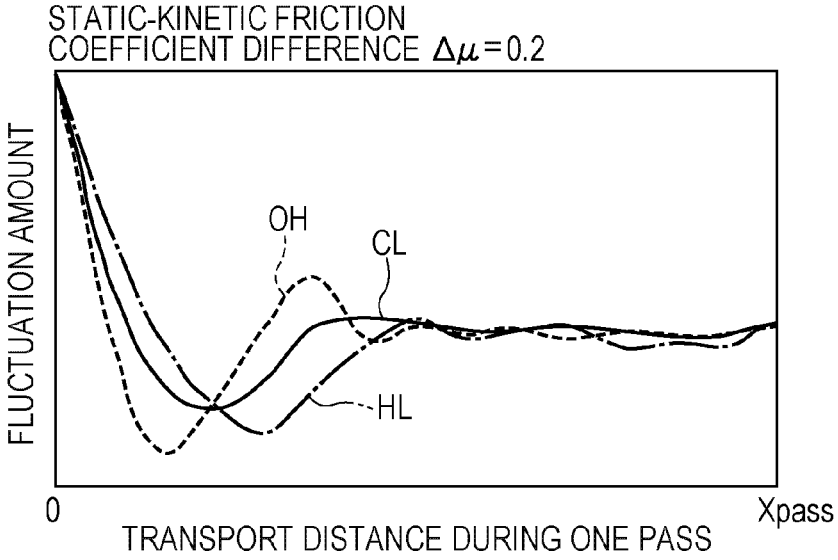

FIGS. 6A to 6C are graphs of the measurement results, where the horizontal axis is the transport distance for one pass, and the vertical axis is the fluctuation amount of the actual transport distance in relation to the target transport distance. FIG. 6A is when the static-kinetic friction coefficient difference Δμ=0, FIG. 6B is when the static-kinetic friction coefficient difference Δμ=0.1 and FIG. 6C is when the static-kinetic friction coefficient difference Δμ=0.2. In each of the graphs, the solid line CL represents the center position, the single dotted chain line HL represents the home side end portion and the broken line OH represents the end portion opposite the home side.

As can be understood from the graphs shown in FIGS. 6A to 6C, when the static-kinetic friction coefficient difference Δμ=0 and when the static-kinetic friction coefficient difference Δμ=0.1, the fluctuation amount of the actual transport distance in the transport distance of one pass was small, and the fluctuation amount stayed within the tolerance limit value or less. Therefore, in order to keep the fluctuation amount of the actual transport distance within the tolerance limit value or less, it is possible that the static-kinetic friction coefficient difference Δμ≤0.1 be satisfied. Here, the tolerance limit value is a value determined from a tolerance limit value of the deviation of the printed dots, which is determined from the demanded print quality. Furthermore, in each of the above evaluations, since, according to the elastomer, the elastic member 25 satisfied "friction coefficient μ≥0.4" and "static-kinetic friction coefficient difference μ≤0.1", in the present embodiment, the elastic friction surface 25*a* is formed using the elastic member 25 formed from the elastomer.

Description will be given below of the actions of the printer 11, which is configured as follows.

When execution of the printing starts in the printer 11, the recording medium M is dispatched from the roll body R1 of the feed unit 16. The dispatched recording medium M is transported along the support surface 42*a* of the support member 42. The ink is ejected from the recording head 41 and an image or the like is printed onto the recording medium M within the main body 13. At this time, for the printing, a recording operation in which ink droplets are ejected from the recording head 41 while the carriage 40 moves in the main scanning direction and a transport operation in which the recording medium M is transported in the transport direction to the next recording position are performed substantially alternately. Accordingly, the image or the like is printed to the recording medium M on the basis of the printing data.

The recording medium M after the printing is transported along the support surface 17*a* of the discharge support portion 17. At this time, the recording medium M on the support surface 17*a* is heated by the heat of the after-heater 48, and the printed image on the recording medium M is fixed due to the ink adhered onto the surface thereof drying.

In addition, at the end portion of the downstream side of the discharge support portion 17, the recording medium M is transported while sliding on the elastic friction surface 25*a* formed from the elastic member 25. In addition, the recording medium M between the discharge support portion 17 and the winding unit 18 is pressed by the tension roller 22 from the rear surface, and is wound as the roll body R2 by the winding unit 18 in a state of tension being applied.

In a case in which, for example, the recording medium M is wound onto the roll body R2 with a bias, the biased force during the winding propagates to the upstream side in the transport direction. Such a biased force brings about skewing of the recording medium M, which causes a reduction in the printing quality due to the positional deviation of the landing of the ink droplets ejected from the recording head 41. In addition, when the recording medium M is wound onto the roll body R2 at a biased position in the axial direction, the recording medium M is wound while deviating a little at a time in one direction of the axial direction of the roll body R2, and once it has been wound to a certain degree, next, the recording medium M is wound while deviating a little at a time in the other direction (the opposite direction) in relation to the axial direction of the roll body R2. Furthermore, the substantially alternate repetition of this deviation causes the recording medium M to meander between the transport unit 33 and the winding unit 18.

In the present embodiment, the recording medium M receives a comparatively large sliding resistance at a location at which it slides on the elastic friction surface 25*a*. Therefore, even if a force works to displace the recording medium M in the width direction, the recording medium M is less apt to slide in the width direction relative to the force. That is, since the recording medium M is less apt to sliding, even if a force is applied thereto in the width direction, due to a comparatively great sliding resistance received from the sliding location with the elastic member 25, the force to make the recording medium deviate in the width direction is less apt to propagate to the upstream side of the sliding location. Therefore, positional deviation is less apt to occur in the width direction in relation to the printing region of the recording medium M onto which the recording head 41 performs printing. As a result, even in a case in which the winding unit 18 winds the recording medium M with a bias, comparatively high image quality printing is performed. In addition, since the elastic member 25 is formed from an elastomer, even if the recording medium M slides on the elastic member 25, the rear surface of the recording medium M is less susceptible to scratching.

According to the present embodiment, as described in detail above, it is possible to obtain the following effects.

1. The elastic member 25 is provided on the end portion of the downstream side in the transport direction of the discharge support portion 17, therefore, according to the sliding resistance between the recording medium M and the elastic member 25, the biased force during the winding is less apt to propagate to the upstream side of the transport direction, and, for example, the deviation in the width direction of the recording medium M in relation to the printing region may be suppressed. Accordingly, it is possible to form a high quality printed image on the recording medium M. In addition, the elastic friction surface 25*a* is formed on the end portion of the downstream side of the discharge support portion 17, and the elastic member 25 is provided on a position most distanced from the printing region opposing the recording head 41 toward the downstream side in the transport direction on the support surface 17*a*. Therefore, even if the recording medium M were to slide on the elastic friction surface 25*a* and become displaced in the width direction, it is possible to significantly suppress the displacement amount in the width direction in relation to the printing region, relative to the displacement amount.

2. The difference between the static friction coefficient and the kinetic friction coefficient, between the elastic member 25 and the recording medium M (the static-kinetic friction coefficient difference) $\Delta\mu$, was set to 0.1 or less ($\mu \leq 0.1$). Accordingly, it is possible to reduce jamming which occurs during transport and is caused by the static-kinetic friction coefficient difference $\Delta\mu$ being great, and it is possible avoid a reduction in the transport position accuracy of the recording medium M. As a result, it is possible to transport the recording medium M with a comparatively high position accuracy.

3. An elastic member 25 was used which was formed from a material in which the friction coefficient $\mu$ of the elastic member 25 is 0.4 or higher, in which the deviation amount in the width direction of the recording medium M stays within the tolerance limit value or less. Accordingly, it is possible to suppress the positional deviation amount in the width direction of the recording medium M in relation to the printing region.

4. An elastomer was used for the elastic member 25. Accordingly, it is possible to set the friction coefficient $\mu$ of the elastic member 25 to 0.4 or higher, and to set the static-kinetic friction coefficient difference $\Delta\mu$ of the elastic member 25 to 0.1 or less. Accordingly, it is possible to suppress the positional deviation in the width direction of the recording medium M and to increase the transport position accuracy of the recording medium M. As a result, it is possible to perform printing of a high quality on the recording medium M.

5. The elastic member 25 forms the first support surface portion 61 on which, on the end portion of the downstream side on the discharge support surface portion 17, the recording medium M discharged without being wound and the recording medium M discharged and wound both slide. Further the elastic member 25 also forms the second support surface portion 62, which is formed from a convex surface continuous with the first support surface portion 61 on the downstream side in the transport direction, and on which the recording medium M discharged without being wound does not slide, however, on which the wound recording medium M does slide. Accordingly, it is possible to decrease the frictional resistance force which the recording medium M discharged without being wound receives due to sliding on the elastic friction surface 25*a* at the end portion of the downstream side of the support surface 17*a* of the discharge support portion 17. For example, it is possible to reduce the jamming at the contact location between the recording medium M and the elastic friction surface 25*a*.

6. The elastic member 25 is provided across a range including at least the maximum range at which the recording medium M slides on the support surface 17*a*, where the recording medium M changes its transport path between the discharge support portion 17 and the winding unit 18 according to changes in the winding diameter and the winding direction of the roll body R2. Therefore, the recording medium M which is discharged without being wound does not significantly catch on the end portion of the downstream side in the transport direction of the support surface 17*a*. In addition, in the recording medium M which is wound by the winding unit 18, even if the recording medium M were to be wound with a bias, it is possible to suppress a biased force during the winding from propagating to the upstream side in the transport direction using a comparatively high friction resistance.

7. The elastic member 25 is provided such that the length L1 of the first support surface portion 61 is shorter than the length L2 of the second support surface portion 62 in a direction along the transport path. Therefore, the sliding surface area between the recording medium M discharged without being wound and the elastic member 25 is relatively small, and the recording medium M is even less apt to catch on the end portion of the downstream side of the support surface 17*a*.

Furthermore, the embodiment described above can also be modified to the forms described below.

The elastic member 25 is not limited to a material having a friction coefficient of 0.4 or higher, and having a static-kinetic friction coefficient difference $\Delta\mu$ of 0.1 or less. If the friction coefficient is 0.4 or higher, a material in which the static-kinetic friction coefficient difference $\Delta\mu$ exceeds 0.1 (for example, 0.2) may be used. According to this configuration, it is possible to suppress the positional deviation in the width direction of the recording medium M. In addition, if the static-kinetic friction coefficient difference $\Delta\mu$ is 0.1 or less, a material having a friction coefficient of less than 0.4 (for example, 0.3) may be used for the elastic member 25. According to this configuration, it is possible to suppress the dispersion of the transport position of both ends in the width direction of the recording medium M.

The elastic member 25 may be provided on the end portion of the downstream side of the discharge support portion 17 such that the elastic member 25 covers the first support surface portion 61 and does not cover the second support surface portion 62. In addition, conversely, the elastic member 25 may be provided such that it covers the second support surface portion 62 and does not cover the first support surface portion 61. According to this configuration, the recording medium M to be wound sliding on the elastic member 25, it is possible to suppress the positional deviation on the upstream side thereof, and it is easier to avoid the recording medium M not to be wound jamming at the elastic member 25.

The elastic member 25 may also be provided intermittently across the width direction of the support surface 17*a*. According to this configuration, since the transport resistance in relation to the transport direction may be suppressed, the transport is smoother than a case in which the elastic member 25 is provided continually across the entire range of the width direction of the support surface 17*a* while suppressing the deviation in the width direction of the recording medium M by the friction resistance of the elastic member 25. Therefore, it is easy to further avoid the recording medium M not to be wound jamming at the elastic member 25. Furthermore, in a case in which the elastic member 25 is provided intermittently, the elastic member 25 may be provided divided into several locations across the entire region in the width direction of the support surface 17*a*, and the elastic member 25 may also be provided partially, not across the entire region, only at locations which are necessary. It is possible to arrange the elastic member 25 at least near both end portions in the width direction of the recording medium M, and, at the center of the recording medium M from both end portions in the width direction thereof.

The path M1 on the most external side within the recording medium M to be wound may be set so as to pass closer to the path M2 side than the path M3 side, and the first support surface portion 61 and the second support surface portion 62 may be defined.

The elastic member 25 is not limited to an elastomer, and may also be rubber, foamed resin or the like. In addition, the member provided on the end portion of the downstream side of the support surface 17*a* is not limited to an elastic member. Surface treatment may be performed to increase the friction coefficient of the end portion of the downstream side of the support surface 17*a* without further providing a member such as the elastic member.

An embodiment of the invention may also be applied to a printer not provided with the tension roller 22 on the winding unit 18 side.

The recording apparatus is not limited to an ink jet printer, and may also be a dot impact printer or a laser printer. Furthermore, the recording apparatus is not limited to a serial printer, and may also be a line printer or a page printer.

The recording apparatus may also be a multifunction machine provided with a printing function, a scanner function and a copy function.

The recording medium is not limited to a resin film or paper, and may be any long medium which can be wound into a roll shape, such as a resin sheet, a metal foil, a metal film, a composite film (a laminate film) of a resin and a metal, a woven fabric, a non-woven textile or a ceramic sheet. In addition, the medium is not limited to a recording medium, and may also be a medium to which treatment other than recording (printing) is performed. For example, a tape-shaped substrate made of resin (for example, made of a polyimide resin) may also be used.

The medium transport apparatus is not limited to being provided in a recording apparatus, and may also be provided in a treatment apparatus in which a treatment other than printing is performed. For example, a medium transport apparatus may also be adopted which transports a medium into a drier for performing drying treatment. In addition, the medium transport apparatus may be adopted for a surface treatment apparatus which performs surface treatment such as coating and surface modification on a medium. In addition, the medium transport apparatus may be adopted in a treatment apparatus which performs punching treatment on a medium. Furthermore, the medium transport apparatus may be adopted in a plating apparatus which performs electroless plating on a medium. The medium transport apparatus may also be applied in relation to a circuit formation apparatus which prints a circuit onto a tape-shaped substrate. Furthermore, the medium transport apparatus may be adopted in a measurement apparatus which acquires a measurement value of thickness, surface roughness or the like of a medium. Furthermore, the medium transport apparatus may be adopted in test equipment which tests a medium.

The support surface 17*a* of the discharge support portion 17 may also be a flat planar surface, not a curved surface. In addition, the support surface 17*a* is not limited to an oblique surface which declines toward the downstream side in the transport direction, and may be a flat planar surface which extends in a substantially horizontal state parallel to the support surface of the recording support portion, and may also be an oblique surface which rises toward the downstream side in the transport direction. In addition, this rising oblique surface may also be a concave surface in which the treatment surface (for example, the printing surface) side of a medium is concave, or, may also be a convex surface in which the treatment surface side of the medium is convex.

The entire disclosure of Japanese Patent Application No. 2012-098825, filed Apr. 24, 2012, and 2013-041583, filed Mar. 4, 2013, are expressly incorporated by reference herein.

What is claimed is:

1. A medium transport apparatus, comprising:

a transport unit which transports a long medium to a downstream side;

a winding unit which winds the medium transported to the downstream side by the transport unit; and a medium support portion which is arranged between the transport unit and the winding unit in a transport path and has a medium support surface which supports the medium, wherein a friction coefficient between the medium support surface at an end portion of the downstream side in the transport direction and the medium is higher than a friction coefficient between the medium support surface at an upstream side in the transport direction from the end portion of the downstream side and the recording medium, wherein the support surface is a continuous surface from the upstream side to the downstream side to thereby provide sliding resistance to the medium, wherein the end portion of the downstream side of the continuous support surface is at least partially curved.

2. The medium transport apparatus according to claim 1, wherein a difference between a static friction coefficient and a kinetic friction coefficient, between the medium support surface at the end portion of the downstream side and the medium, is set to 0.1 or less.

3. The medium transport apparatus according to claim 1, wherein an elastic member formed from an elastomer is provided on the end portion of the downstream side of the medium support surface.

4. The medium transport apparatus according to claim 3, wherein the elastic member forms a first support surface portion of a substantially flat planar surface shape on which a medium which is discharged without being wound by the winding unit and a medium which is wound by the winding unit can slide together; and a second support surface portion of a convex surface shape which is continuous with the first support surface portion on the downstream side in the transport direction and curves to a side distanced from the medium when the medium is positioned on the first support surface portion, and on which the medium wound by the winding unit can slide.

5. The medium transport apparatus according to claim 4, further comprising:

a pressing portion which applies tension to the medium by pressing a portion thereof between the medium support portion and the winding unit, and is provided to swing freely;

wherein the second support surface portion is across the range over which a sliding position of the medium in relation to the medium support surface is changed according to the change in the transport path between the medium support portion and the pressing portion.

6. The medium transport apparatus according to claim 4, wherein the first support surface portion is shorter than the second support surface portion in relation to a direction along the transport path.

7. A recording apparatus comprising:

the medium transport apparatus according to claim 1; and a recording unit which performs recording on a recording medium transported by the medium transport apparatus.

8. A recording apparatus comprising:

the medium transport apparatus according to claim 2; and a recording unit which performs recording on a recording medium transported by the medium transport apparatus.

9. A recording apparatus comprising:

the medium transport apparatus according to claim 3; and a recording unit which performs recording on a recording medium transported by the medium transport apparatus.

10. A recording apparatus comprising:

the medium transport apparatus according to claim 4; and a recording unit which performs recording on a recording medium transported by the medium transport apparatus.

11. A recording apparatus comprising:

the medium transport apparatus according to claim 5; and a recording unit which performs recording on a recording medium transported by the medium transport apparatus.

12. A recording apparatus comprising:

the medium transport apparatus according to claim 6; and a recording unit which performs recording on a recording medium transported by the medium transport apparatus.

* * * * *